US006036384A

United States Patent [19]

Suzuki

[11] Patent Number: 6,036,384

[45] Date of Patent: Mar. 14, 2000

[54] PRINTER FOR PRINTING EDGE MARKS ON GAMING TICKETS

[75] Inventor: Kanji Suzuki, Shizuoka, Japan

[73] Assignee: Star Micronics Co., Ltd., Shizuoka, Japan

[21] Appl. No.: 08/995,137

[22] Filed: Dec. 19, 1997

[30] Foreign Application Priority Data

Dec. 25, 1996 [JP] Japan ..... 8-356963

[51] Int. Cl.[7] ..... B41J 29/18

[52] U.S. Cl. ..... 400/708; 400/279; 400/283

[58] Field of Search ..... 400/708, 279, 400/70, 76, 61, 283; 101/35, 66

[56] References Cited

U.S. PATENT DOCUMENTS

| | | | |
|---|---|---|---|
| 4,398,708 | 8/1983 | Goldman et al. | 270/18 |
| 4,652,159 | 3/1987 | Nagai | 400/322 |
| 5,158,379 | 10/1992 | Moriya et al. | 400/279 |
| 5,416,395 | 5/1995 | Hiramatsu et al. | 318/600 |
| 5,599,116 | 2/1997 | Ueda | 400/323 |
| 5,818,019 | 10/1998 | Irwin, Jr. et al. | 235/375 |
| 5,894,315 | 4/1999 | Yamane | 347/37 |
| B1 5,158,379 | 3/1996 | Moriya et al. | 400/279 |

FOREIGN PATENT DOCUMENTS

| | | |
|---|---|---|
| 6-115213 | 4/1994 | Japan . |
| 7-52490 | 2/1995 | Japan . |

*Primary Examiner*—John Hilten
*Assistant Examiner*—Charles H. Nolan, Jr.
*Attorney, Agent, or Firm*—Whitham, Curtis & Whitham

[57] ABSTRACT

A printer comprising a carriage making reciprocating movement and a printing head mounted thereon, the movement of the carriage comprising an outward section from a home position to the other position, a homeward section from the other position to the home position, and two reverse sections to change the direction of the movement, a printing being made on a printing paper by defining the outward and homeward sections as a printing area, in which, when printing includes a mark printing to print a mark on an edge of the printing paper, the mark printing is carried out by using one of the reverse sections.

12 Claims, 11 Drawing Sheets

PRINTER FOR PRINTING EDGE MARKS ON GAMING TICKETS

BACKGROUND OF THE INVENTION

1. Field of the Invention

The present invention relates to a dot-impact type of printer, more particularly, for printing marks on the edge of printing paper, which prevents fracture of a wire of a printing head and can print the desired marks on the edge of printing paper without requiring a large-sizing of printer.

2. Description of the Related Art

FIG. 10 shows an example of printed matter on which markings are printed on the edge of printing paper. The printed matter in FIG. 10 is recognized as "instant lottery ticket." There is a paper 101 in a predetermined shape and size, on which predetermined numbers, etc. have been printed in advance in predetermined rows. Marks 103 are printed at predetermined positions, including those on the left edge of the paper 101.

When a person buys the instant lottery ticket as shown in FIG. 10, he may select arbitrary number among the numbers printed in a predetermined row, then marks the selected number by drawing any checking line or painting it out, etc. The thus number-marked paper 101 is inserted in a data reader (OCR). The OCR detects the marks 103 printed on the left edge of the paper 101, so that the number in each row marked by the buyer may be detected.

FIG. 11 shows another type of printed matter like above. This kind of paper is printed by a certain type of machine when drawing a lottery. For example, when a person buys the lottery by selecting arbitrary number, etc., a receipt 105 as shown in FIG. 11 is issued. The receipt 105 has marks 109 at the predetermined positions including those on the left edge of the receipt 105. These marks 109 specify the information selected by the buyer. The information is then confirmed by inserting the receipt 105 in the OCR, so that the result (win or lose) in the lottery may be discriminated.

However, the prior arts as above described have the following problems.

Firstly, when marks 103 or 109 are to be printed on the left edge of the paper 101 or the receipt 105, it is necessary to start moving the head from the further side of the left edge of the paper. Namely, the printing should be carried out by moving a printing head toward the right side, starting from the further side of the left edge of the paper 101 or the receipt 105. In such an operation, a wire of the printing head may be caught on the left edge of the paper 101 or the receipt 105, which result in fracture of the wire.

Secondly, there is a problem of large-sizing of printer. When the printing is to be carried out on the edge of the paper 101 or the receipt 105, it is necessary to extend the printing area in the lateral direction to allow the further starting position as above. Thus the width of the printer shall be enlarged, which results in the large-sizing of printer.

For detailed explanation, as for a carriage of the printing head which ordinarily makes reciprocating movement, there are reverse areas at both ends of the printing area, in which the carriage changes its moving direction (from the movement toward the left side, to that toward the left side, and vice versa), and such reverse areas are not included in the printing area. Namely, the printing is carried out only in the area excluding the reverse areas. Accordingly, if the edges of the paper 101 or the receipt 105 should be included in the printing area, the printing area shall naturally be enlarged, thus the width of the printer is enlarged, which results in the large-sizing of printer.

SUMMARY OF THE INVENTION

It is an object of the present invention to provide a printer which can print on edges of a printing paper, by preventing fracture of a wire of a printing head.

To achieve the object mentioned above, according to the present invention, there is provided a printer comprising a carriage making reciprocating movement and a printing head mounted thereon, the movement of the carriage comprises an outward section to move from a home position to the other position, a homeward section to move from the other position to the home position, and two reverse sections respectively provided between the outward section and the homeward section to respectively change the direction of the movement, a printing is carried out on a printing paper by the printing head by defining the outward and homeward sections as a printing area, in which, when contents of printing include a mark printing which prints a mark on an edge of the printing paper on the side of the home position or the other position, the mark printing is carried out by using one of the reverse sections.

Preferably, the printer may include a judging means to decide whether contents of printing are only ordinary printings or include the mark printing, and a control means, under decision by the judging means that printing includes the mark printing, which controls, when the mark is printed on the edge of the printing paper on the home position side, to carry out printing in the homeward section and to carry out the mark printing in the reverse section which changes the movement from the homeward section to the outward section, and which controls, when the mark is printed on the edge of the printing paper on the other position side, to carry out printing in the outward section and to carry out the mark printing in the reverse section which changes the movement from the outward section to the homeward section.

Preferably, the printer may include a timing signal generating means to specify a position of the carriage.

Further, there is provided a printer which makes a carriage an outward movement from a home side to the other side and a homeward movement from the other side to the home side, to make a desired printing on the printing paper by a printing head mounted on the carriage, comprising a first printing area used for ordinary printing, a second printing area including outer printing area of the first printing area, a judging means to decide whether contents of printing are only the ordinary printings or include a mark printing to print a mark on any edge of the printing paper on the home side or the other side, and a control means, which carries out printing by using the first printing area when the judging means decides that printing is only for the ordinary printing, and which carries out printing by using the second printing area when the judging means decides that printing includes the mark printing.

Preferably, under decision by the judging means that printing includes the mark printing, the control means may decide on which side of the printing paper the mark printing is made, and may carry out printing in the homeward movement when the mark printing is made on the edge of the printing paper on the home side, and may carry out printing in the outward movement when the mark printing is made on the edge of the printing paper on the other side.

Preferably, the printer may include a timing signal generating means to specify a position of the carriage.

The printing paper may be a lottery ticket, receipt, etc.

With this structure, the printer according to the present invention carries out the mark printing in the reverse areas positioned at both ends of the printing area, thus the desired mark printing can be made, without extension of printing area which might cause the large-sizing of printer.

In addition, when the judging means decides whether contents of printing are only ordinary printings or include the mark printing, and the control means controls, under decision by the judging means that printing includes the mark printing, when the mark is printed on the left edge of the printing paper, to carry out printing in the homeward direction and to carry out the mark printing in the reverse area where the moving direction changes from the homeward to the outward, and when the mark is printed on the right edge of the printing paper, to carry out printing in the outward direction and to carry out the mark printing in the reverse area where the moving direction changes from the outward to the homeward. Thus the mark printing is carried out when the printing head moves in the direction from the inside to the outside of the printing paper, and it is possible to prevent damage to a wire of the printing head caught by the marginal edge of the printing paper.

According to the printer of the present invention, firstly, since the mark printing is carried out by using the reverse areas, it is not necessary to extend the printing area, and the large-sizing of printer is not required. Secondly, since the printing on the edge of the printing paper is sure to be carried out starting from the inside of the printing paper, it is possible to prevent the damage to the wire of the printing head caught by the marginal edge of the printing paper. Therefore, the desired printing can be carried out by preventing the damage to the wire of the printing head without requiring the large-sizing of printer.

BRIEF DESCRIPTION OF THE DRAWINGS

The invention will be described below in detail with reference to the accompanying drawings, in which.

DETAILED DESCRIPTION OF THE INVENTION

Figure 1:
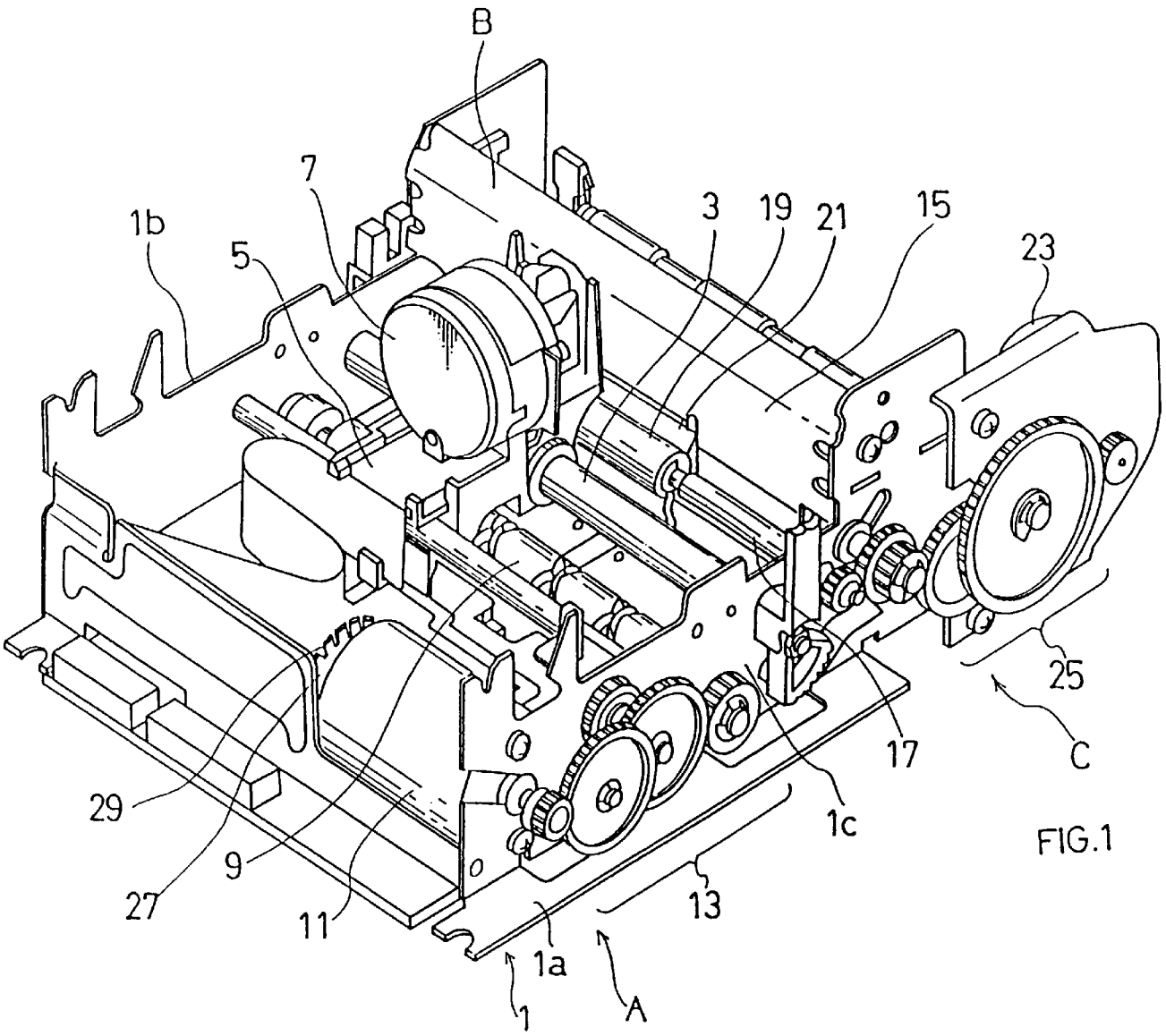
FIG. 1 is a perspective view showing a mechanical structure of a printer according to an embodiment of the present invention.

An embodiment of the present invention will now be described with reference to FIGS. 1 through 9. The mechanical structure of a printer according to the present invention is shown in FIG. 1. Firstly, there is a frame 1 having a bottom wall 1*a* and a pair of side walls 1*b* and 1*c*. A guide shaft 3 is provided between the pair of side walls 1*b* and 1*c*, and a carriage 5 is mounted on the guide shaft 3 to make lateral movement along the guide shaft 3 to the right and left. A printing head 7 is mounted on the carriage 5.

There is a cylindrical cam shaft 9 parallel to the guide shaft 3 in the space between the pair of side walls 1*b* and 1*c*. The space between the pair of side walls 1*b* and 1*c* also has a carriage motor 11, and the carriage motor 11 drives the cylindrical cam shaft 9 to rotate via a gear train 13 comprising a plurality of gears. Thus the carriage 5 moves to the right and left interlocked with the rotation of the cylindrical cam shaft 9.

Accordingly, a carriage driving mechanism A comprises the carriage motor 11, the gear train 13, the cylindrical cam shaft 9, etc.

There is a platen 15 provided facing to the printing head 7, and there is also a shaft 17. A printing mechanism B comprises the printing head 7, the platen 15, etc.

There is a paper feeding roller 19 fixed on the shaft 17, and there is another paper feeding roller 21 opposite with the paper feeding roller 19. A paper feeding motor 23 is provided to drive the shaft 17 to rotate via a gear train 25 comprising a plurality of gears. Thus the paper feeding roller 19 rotates, and an unillustrated paper is fed between the printing head 7 and the platen 15.

Accordingly, a paper feeding mechanism C comprises the paper feeding motor 23, the paper feeding rollers 19 and 21, etc.

Figure 2:
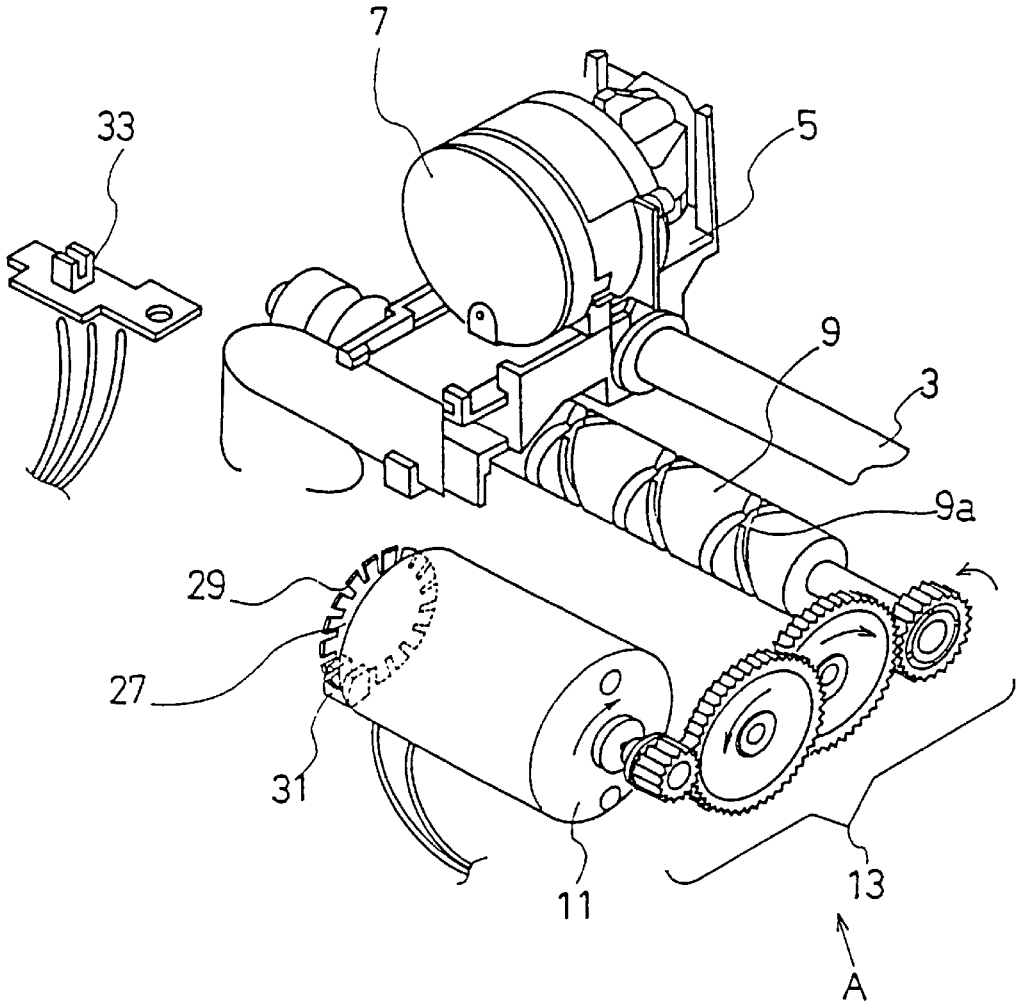
FIG. 2 is a segmentary perspective view showing only a carriage driving mechanism in the mechanical structure of the printer according to the embodiment of the present invention.

To explain the structure of the carriage driving mechanism A which drives the carriage 5, a segmentary view only of the structure thereof is illustrated in FIG. 2. There is the cylindrical cam shaft 9 as above discussed, on which a cam groove 9*a* is formed. There is also an unillustrated cam follower provided on the carriage 5 to be in movable engagement with the cam groove 9*a*. A timing disk 27 is provided in the rear of the carriage motor 11, and the timing disk 27 has a plurality of slits 29 formed along the circumference thereof at regular intervals. A photo interrupter 31 is provided opposite with the timing disk 27. A timing signal generating means comprises the timing disk 27 and the photo interrupter 31.

There is another photo interrupter 33 to detect the position of the carriage 5. The photo interrupter 33 outputs a carriage position signal (home position signal) when an unillustrated plate protruding from the carriage 5 passes.

Figure 3:
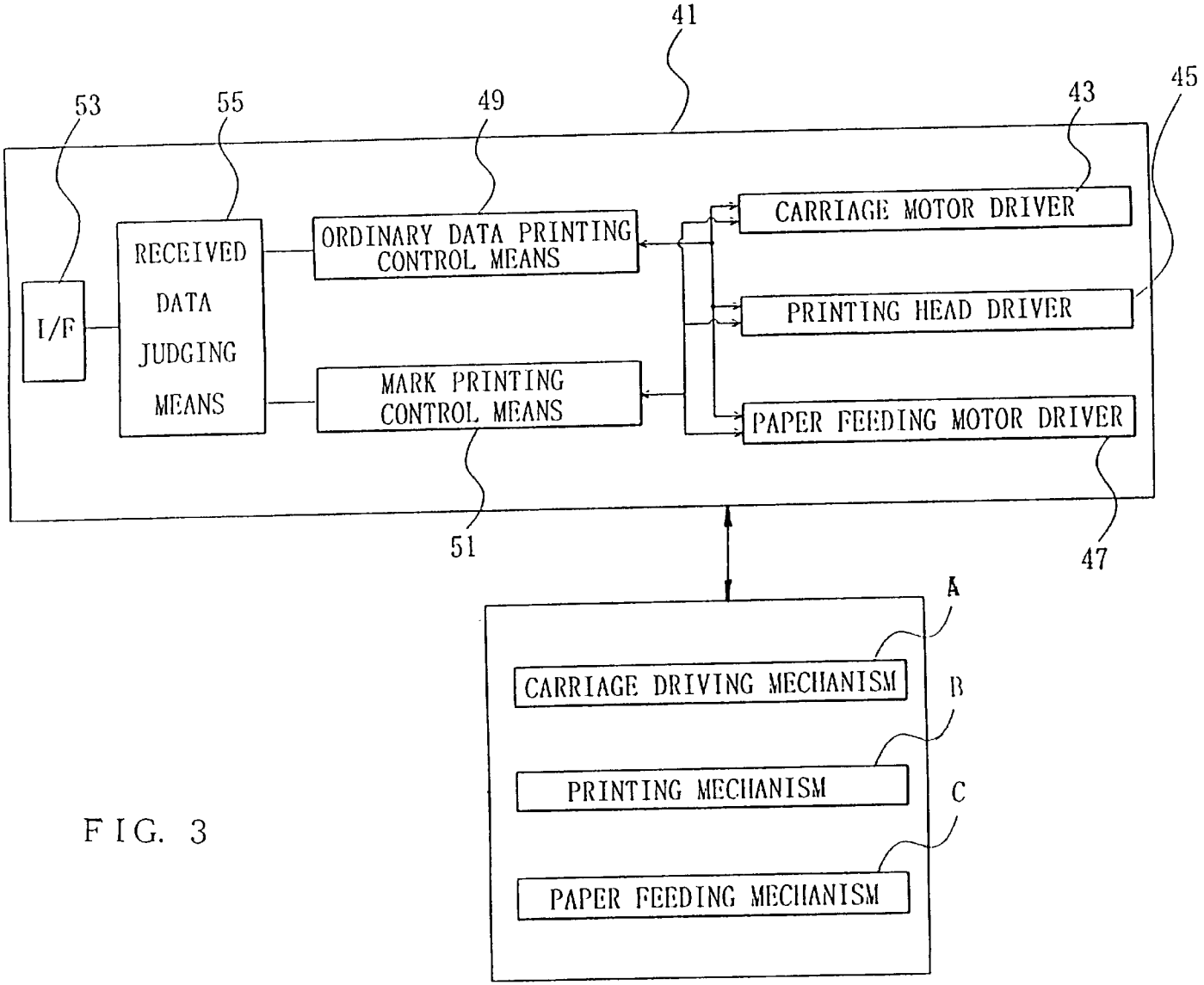
FIG. 3 is a block diagram showing a structure of the printer according to the embodiment of the present invention.

FIG. 3 shows a block diagram of the structure of the printer according to the embodiment of the present invention. As above described, the printer has a mechanical section comprising the carriage driving mechanism A, the printing mechanism B and the paper feeding mechanism C. In addition, the printer has a control means 41. The control means 41 is provided with a carriage motor driver 43, a printing head driver 45, and a paper feeding motor driver 47. The control means 41 also has an ordinary data printing control means 49, a mark printing control means 51, an I/F 53 which receives the printing data transmitted from a host computer, and a received data judging means 55 which decides whether or not the received data include the mark printing.

Figure 4:
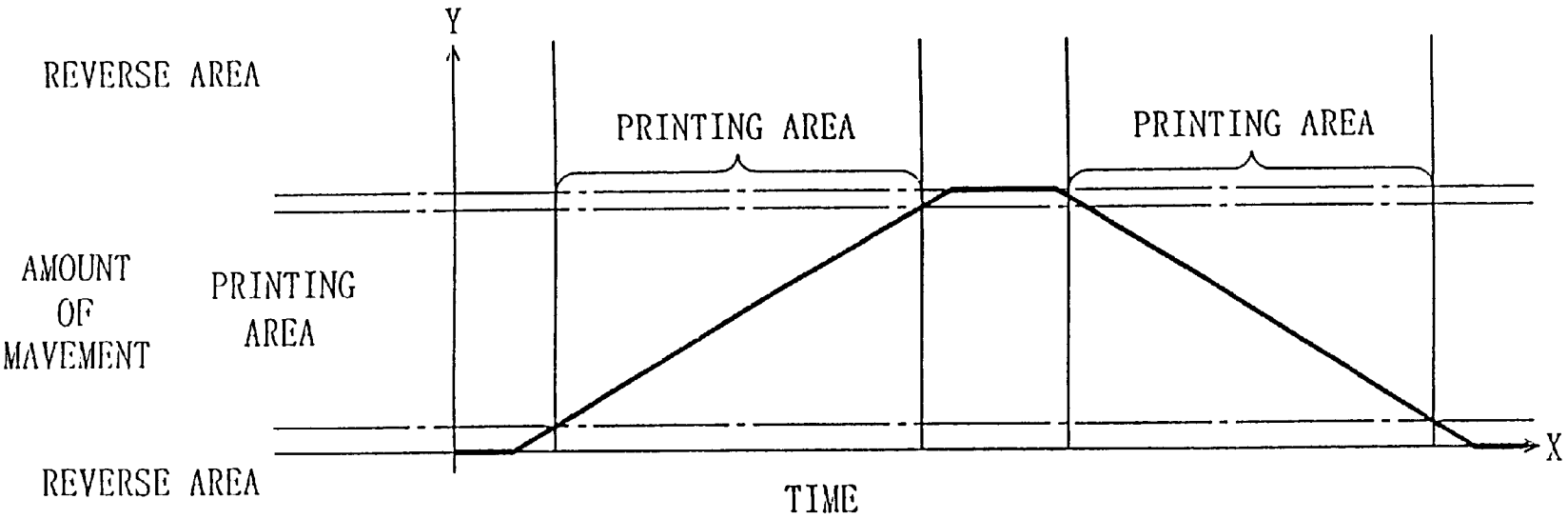
FIG. 4 is a view showing a locus in a cycle of reciprocating movement of a printing head moving in a cam groove of a cylindrical cam shaft according to the embodiment of the present invention.

With regard to the reciprocating motion of the carriage 5, as above described, the carriage 5 makes reciprocating movement by engagement with the cam groove 9*a* of the cylindrical cam shaft 9. FIG. 4 shows a locus of such a reciprocating movement of the carriage 5 by engagement with the cam groove 9*a*, in which a Y-axis represents an amount of movement of the printing head 7, and an X-axis represents a time (number of timing signals) to show a variation thereof. As clearly seen from FIG. 4, in the printing area, the number of timing signals (ti me) is in proportion to the amount of movement of the printing head 7. To the contrary, in the reverse areas (the areas to change the moving direction of the carriage 5 from the outward to the homeward and vice versa), the number of timing signals (time) is out of proportion to the amount of movement of the printing head 7.

According to the embodiment of the present invention, the so-called "mark printing" is carried out in such non-proportional reverse areas. In these areas, since the printing timing is out of proportion to the amount of movement, there may be an occurrence of double-dotted printing. However, there is no problem even if the double-dotted printing occurs, as the printing only relates to the mark printing. It is even favorable because the printing density of the mark may be higher.

Figure 5:
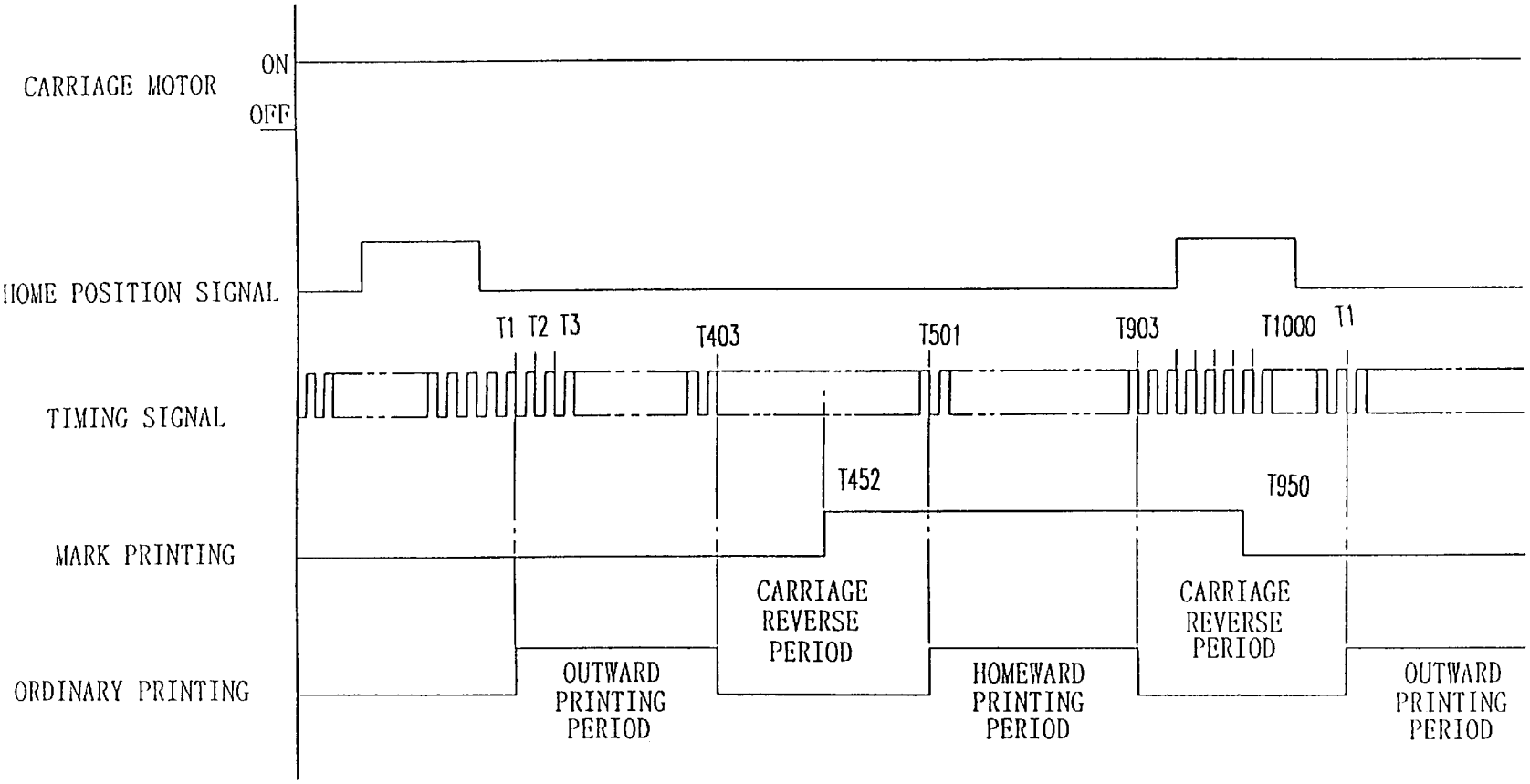
FIG. 5 is a timing chart explaining timings of ordinary printing and mark printing according to the embodiment of the present invention.

FIG. 5 shows a timing chart of printing, in which ON/OFF of the carriage motor 11, the home position signal, the timing signal, the timing of the mark printings, and the timing of the ordinary printings, are respectively indicated. In this connection, the timing signal will be discussed with reference to FIGS. 6 and 7.

Figure 6:
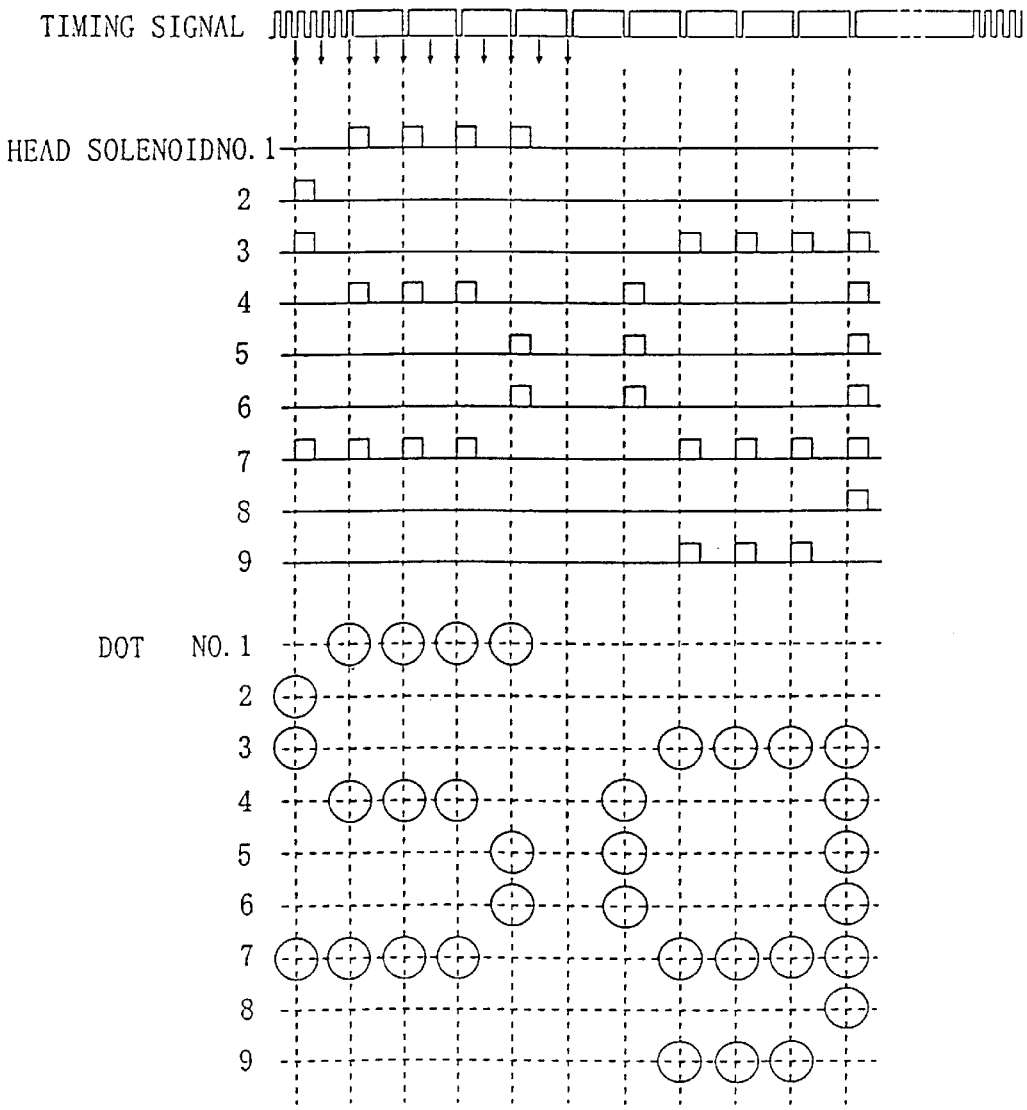
FIG. 6 is a view showing printing timings with determined numbers according to the embodiment of the present invention.
Figure 7:
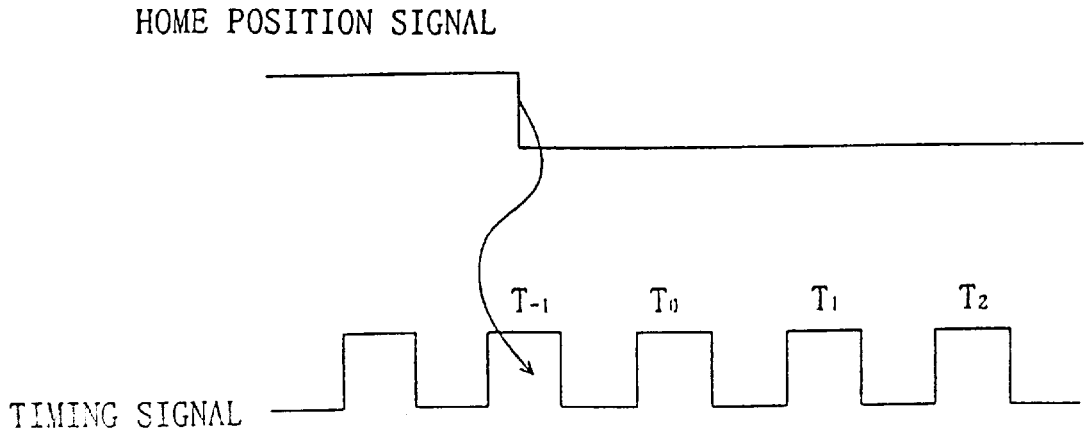
FIG. 7 is a view showing printing timings with determined numbers according to the embodiment of the present invention.

FIG. 6 explains the printing timing of the printer. For further reference, numbering of the timing signal ($T_n$) is determined as shown in FIG. 7. Firstly, a trailing edge of the home position signal from the photo interrupter 33, which detects the position of the carriage 5, is detected. Then the first trailing edge of the timing signal after the above detection of the home position signal, from the timing signal generating means comprising the timing disk 27 and the photo interrupter 33, is determined as $T_{-1}$. Similarly, the sequential trailing edges of the timing signals are determined as $T_0$, $T_1$, $T_2$, and so forth. In such a numbering, the position of the carriage 5 is specified. Accordingly, the printing signals are transmitted to the printing head driver 45 at the predetermined timing as shown in FIG. 6, thus the printing is carried out by the printing mechanism B.

With reference to the above description, FIG. 5 shows the reciprocating movement of the carriage 5 with the determined numbering ($T_n$) of the timing signal, in which $T_1$–$T_{402}$ represent an outward printing period (for example, the movement toward the right) of the carriage 5, $T_{403}$–$T_{500}$ represent a reverse period in which the carriage 5 changes the moving direction from the outward to the homeward (for example, from the movement toward the right to that toward the left), $T_{501}$–$T_{902}$ represent a homeward printing period (for example, the movement toward the left) of the carriage 5, and $T_{903}$–$T_{1000}$ represent a reverse period in which the carriage 5 changes the moving direction from the homeward to the outward (for example, from the movement toward the left to that toward the right). The ordinary printing is carried out in the periods between $T_1$–$T_{402}$ (the outward printing period) and $T_{501}$–$T_{902}$ (the homeward printing period). In addition, the printing including the mark printing is carried out, in the periods starting from the mid of the reverse period to change the direction from the outward to the homeward (namely at $T_{452}$) until reaching the mid of the reverse period to change the direction from the homeward to the outward (namely at $T_{950}$).

Figure 8:
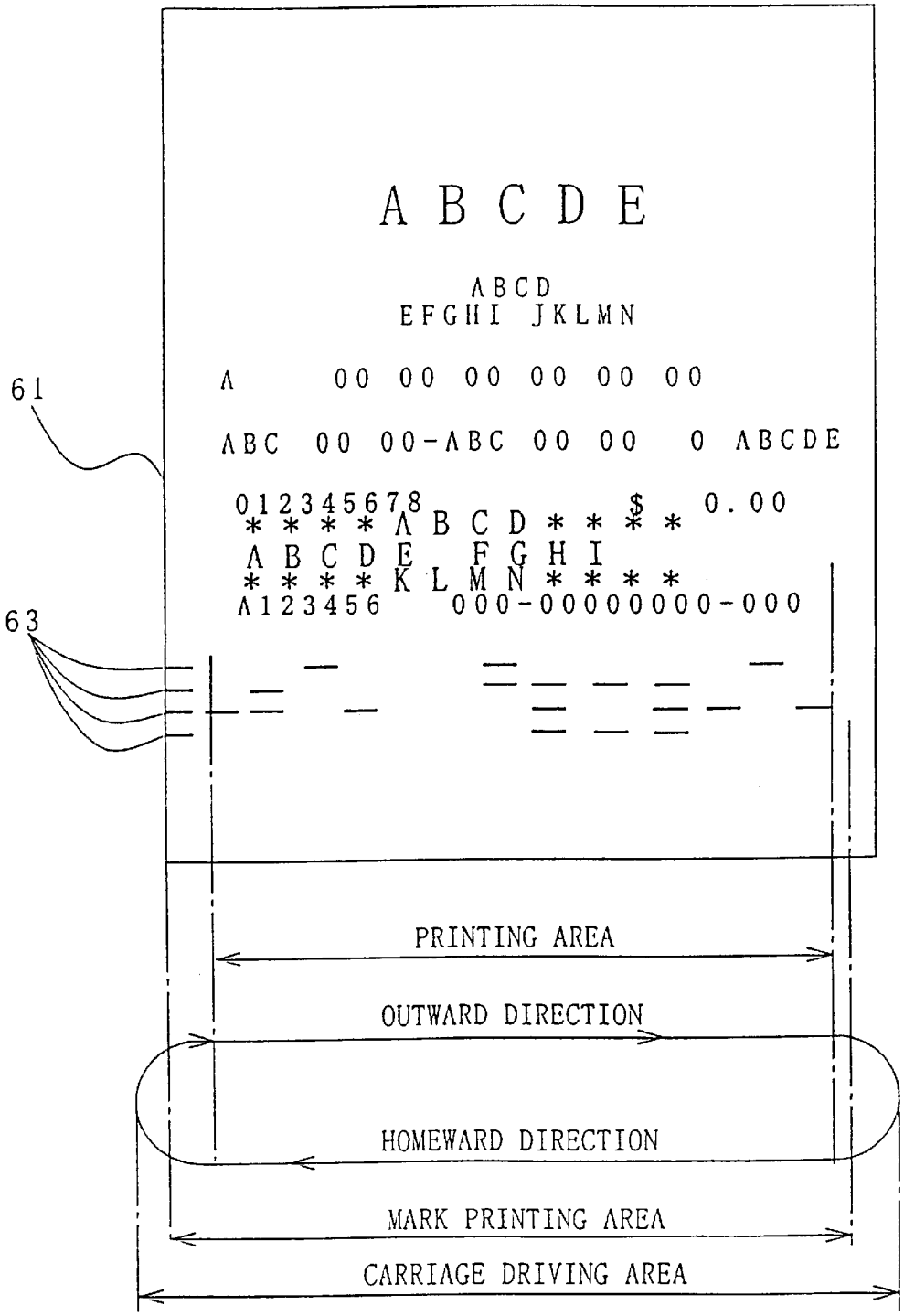
FIG. 8 is a view explaining mark printings on a receipt according to the embodiment of the present invention.

According to the embodiment of the present invention, there may be a case that marks 63 should be printed on a receipt 61 as illustrated in FIG. 8, in which several marks 63 are positioned on the left edge of the receipt 61. Accordingly, the mark printing is carried out at the timing when the carriage 5 moves in the homeward direction (in FIG. 8, the movement of the carriage 5 toward the left), then the mark is printed while the carriage is in the reverse area.

Figure 9:
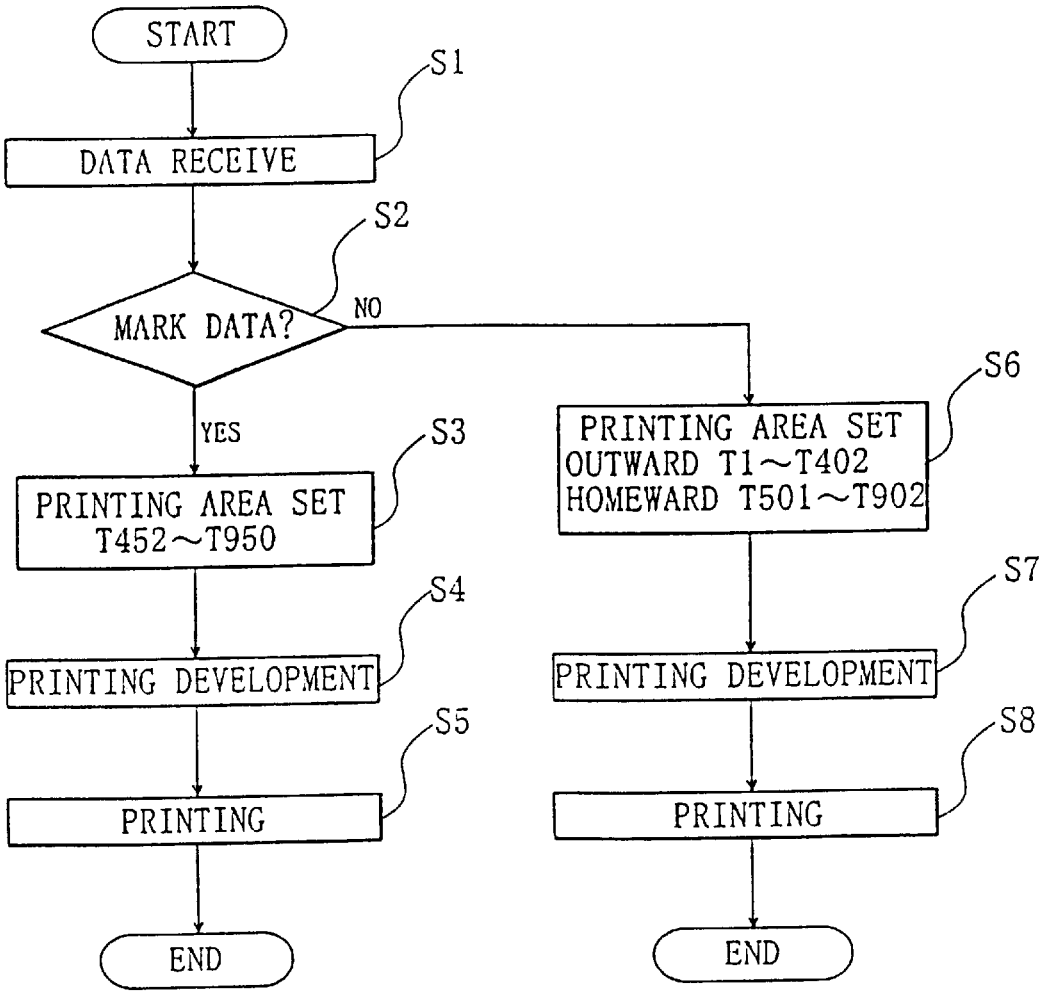
FIG. 9 is a flowchart showing a printing operation according to the embodiment of the present invention.
Figure 10:
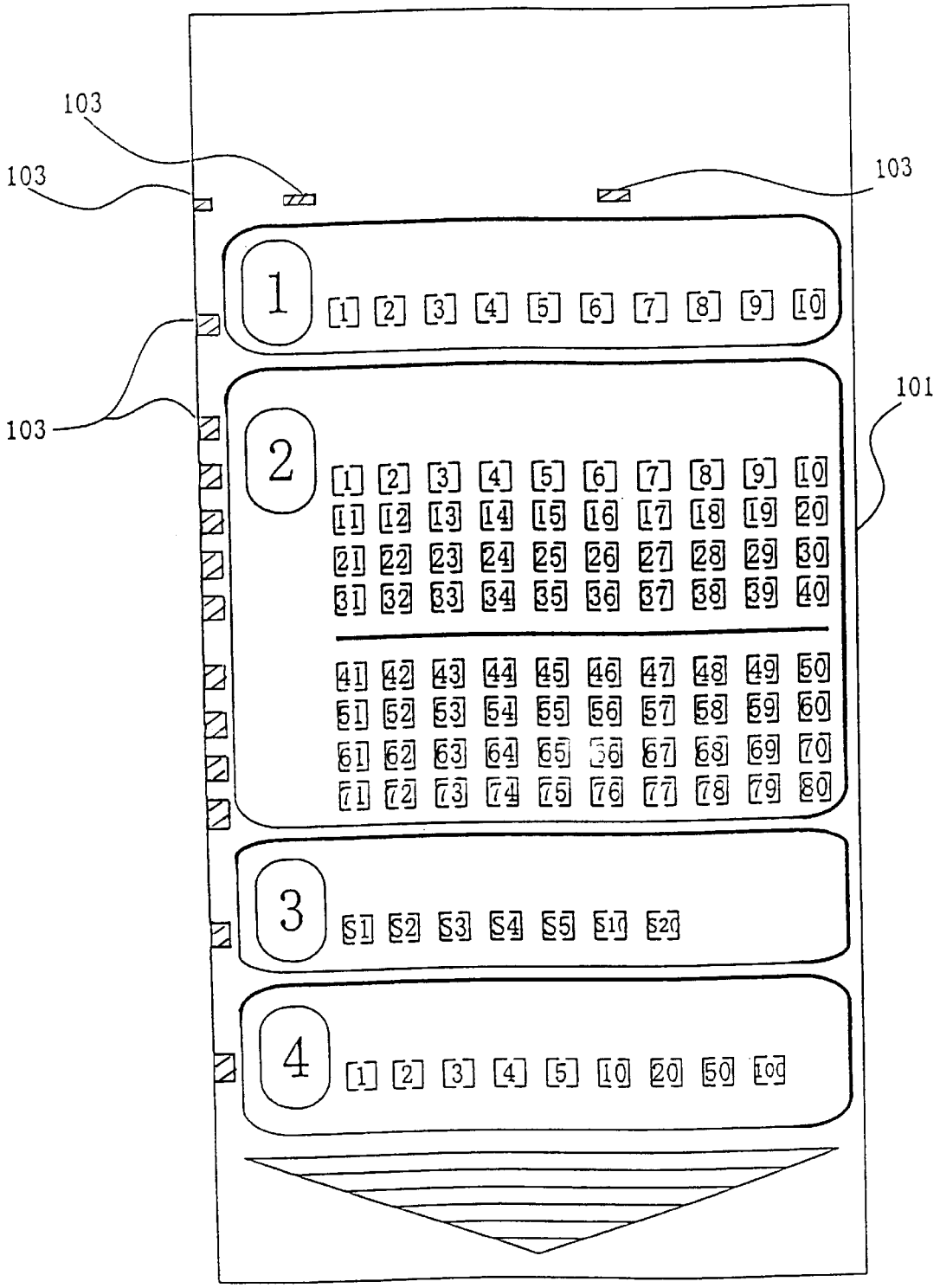
FIG. 10 is a view showing an example of printed matter on which marks are printed.
Figure 11:
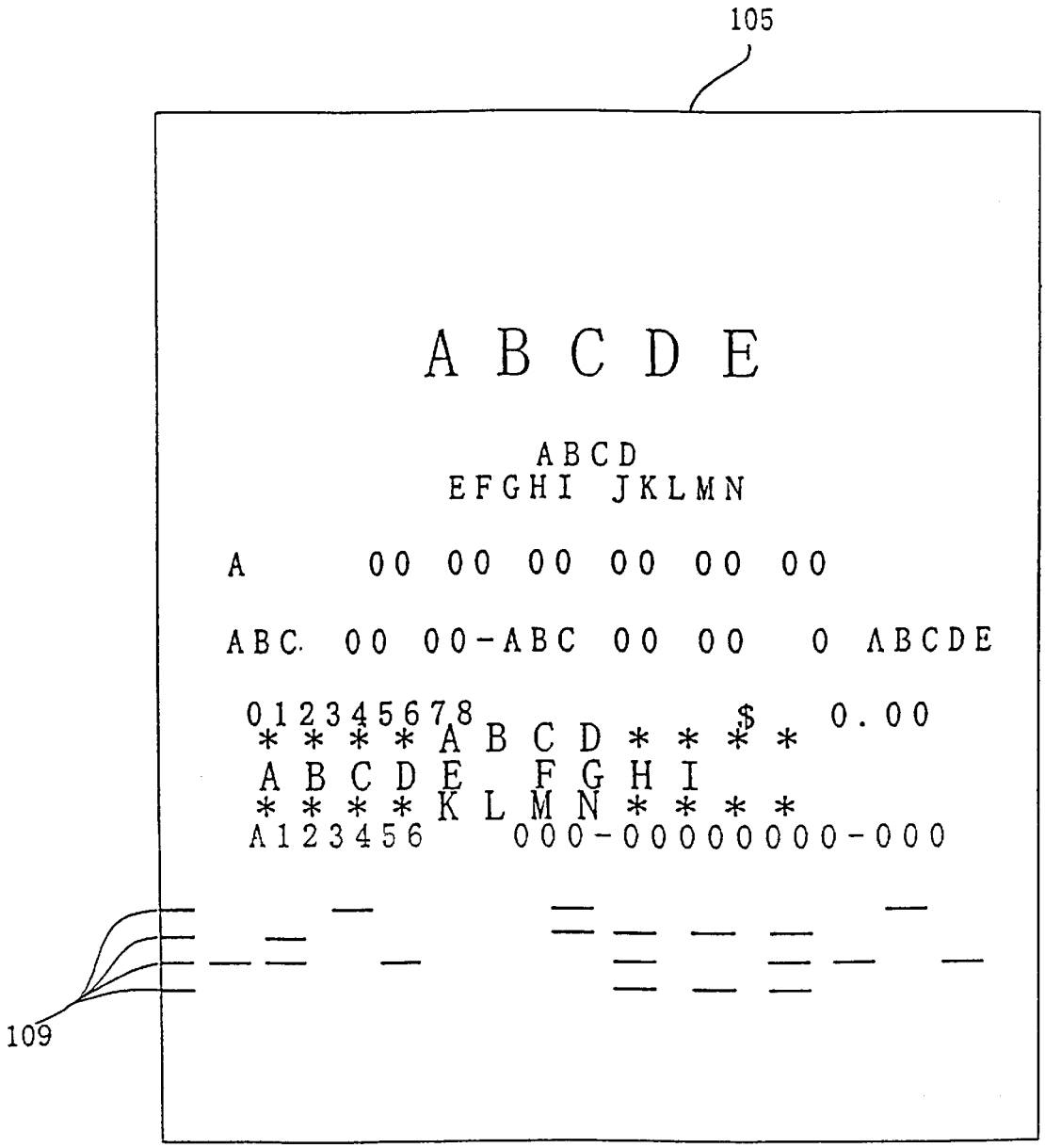
FIG. 11 is a view showing an example of printed matter on which marks are printed.

The printing operation according to the present invention will be described with reference to a flowchart of FIG. 9. Firstly, data is received (step S1), and control proceeds to step S2 to decide whether or not the received data are the mark data. When the received data are the mark data, control proceeds to step S3 to set the printing area. The printing area defined by the period is between $T_{452}$–$T_{950}$ as above described (see FIG. 5). Then control proceeds to step S4 to execute the printing development, and the printing is carried out at step S5, then the printing operation ends.

To the contrary, if the decision is not for the mark data at step S2, control proceed to step S6. In this case, the printing shall be the ordinary printing, thus the printing area is defined by the outward printing period ($T_1$–$T_{402}$) and the homeward printing period ($T_{501}$–$T_{902}$). Then control proceeds to step S7 to execute the printing development, and the printing is carried out at step S8, then the printing operation ends.

The present invention has the following merits.

Firstly, it is possible to avoid the damage to the wire of the printing head 7. The wire may be caught on the marginal edge of the printing paper (in this case, the left edge of the receipt 61) when the marks 63 are printed on the left edge of the receipt 61. However, according to the present invention, it is possible to avoid such a damage because the mark printing is carried out at the timing of movement of the carriage 5 in the homeward direction (namely, the timing of movement toward the left in FIG. 7).

Secondly, it is possible to carry out the desired printing without extending the printing area of the printer. This is because the mark printing is carried out by using the reverse areas, which are not ordinarily used for printing.

As above described, according to the embodiment of the present invention, the printer can carry out the desired mark printing, by avoiding the damage to the wire of the printing head 7, and without requiring the large-sizing of the printer.

The present invention is not limited to the embodiment as described above.

Although the embodiment refers to the case of the mark printing on the left edge of the printing paper, it is of course possible to carry out the mark printing on the right edge of the printing paper. In this case, the mark printing is carried out at the timing of outward movement of the carriage and also in the reverse area to change the moving direction from the outward to the homeward (from the movement toward the left to that toward the right).

In addition, as for the printed marks, it is sufficient to use any dot pattern as long as the problem due to double-dotted printing will not occur. Depending on the purposes, it is even possible to use any ordinary letter pattern as the mark.

What is claimed is:

1. A printer for printing data on a paper sent from a host device comprising:

a carriage making a reciprocating movement within a moving range comprising a printing section and a pair of reverse sections where the direction of movement of said carriage is changed;

a printing head mounted on said carriage;

means for determining whether the data sent from the host device includes a mark to be printed in at least one of the reverse sections; and means for controlling said printing head, in response to said determining means, to print the mark in the at least one of the reverse sections.

2. The printer as claimed in claim 1, further comprising means for determining in which reverse section the mark is to be printed, and wherein said controlling means causes the mark printing to be done in the determined reverse section when said carriage enters the determined reverse section.

3. The printer as claimed in claim 1, further comprising a timing signal generating means for generating a timing signal to specify a position of said carriage.

4. The printer as claimed in claim 2, further comprising a timing signal generating means for generating a timing signal to specify a position of said carriage.

5. A printer for printing data sent from a host device on a paper, comprising:

a carriage making a reciprocating movement within a moving range of the paper comprising a printing section and a pair of reverse sections where the moving direction is changed;

a printing head mounted on said carriage and having a first printing area where time is proportional to the distance that said printing head moves, and a second printing area corresponding to the moving range of said carriage;

means for determining whether the data sent from the host device includes a mark to be printed in at least one of the reverse sections;

means for selecting the first printing area when said determining means determines that the data sent from the host device does not include a mark to be printed in at least one of the reverse sections; and selecting the second printing area when said determining means determines that the data sent from the host device includes a mark to be printed in at least one of the reverse sections; and means for controlling said printing head, in response to said selecting means, to make printing in the selected printing area.

6. The printer as claimed in claim 5, further comprising means for determining in which reverse section the mark is to be printed, and wherein said controlling means causes the mark printing to be done in the determined reverse section when said carriage enters the determined reverse section.

7. The printer as claimed in claim 5, further comprising a timing signal generating means for generating a timing signal to specify a position of said carriage.

8. The printer as claimed in claim 6, further comprising a timing signal generating means for generating a timing signal to specify a position of said carriage.

9. The printer as claimed in claim 8, in which the printing paper comprises one of a lottery ticket and a receipt.

10. The printer as claimed in claim 5, in which the printing paper comprises one of a lottery ticket and a receipt.

11. The printer as claimed in claim 6, in which the printing paper comprises one of a lottery ticket and a receipt.

12. The printer as claimed in claim 7, in which the printing paper comprises one of a lottery ticket and a receipt.

* * * * *

UNITED STATES PATENT AND TRADEMARK OFFICE

CERTIFICATE OF CORRECTION

PATENT NO. : 6,036,384
DATED : March 14, 2000
INVENTOR(S) : Kanji Suzuki

It is certified that error appears in the above-identified patent and that said Letters Patent is hereby corrected as shown below:

On the title page, item [54] and in column 1, delete the current title and replace it with the following "PRINTER FOR PRINTING EDGE MARKS ON TICKETS".

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*